United States Patent [19]

Weisner et al.

[11] Patent Number: 4,730,426

[45] Date of Patent: Mar. 15, 1988

[54] STANDING SEAM SKYLIGHT FOR TILE ROOFS

[75] Inventors: Kent A. Weisner, Maitland; Lester L. Walls, Jr., Deltona; Clifford Sanders, Ocoee, all of Fla.

[73] Assignee: Kenergy Corporation, Orlando, Fla.

[21] Appl. No.: 917,846

[22] Filed: Oct. 14, 1986

Related U.S. Application Data

[63] Continuation-in-part of Ser. No. 700,106, Feb. 11, 1985, Pat. No. 4,649,680.

[51] Int. Cl.[4] ..... E04B 7/18

[52] U.S. Cl. ..... 52/200; 52/533

[58] Field of Search ..... 52/200, 533, 72, 101

[56] References Cited

U.S. PATENT DOCUMENTS

| | | | |
|---|---|---|---|
| 1,585,503 | 2/1927 | Larsen | 52/101 X |
| 4,117,638 | 10/1978 | Kidd, Jr. et al. | 52/200 |
| 4,559,753 | 12/1985 | Brueske | 52/200 X |

FOREIGN PATENT DOCUMENTS

| | | | |
|---|---|---|---|
| 4877 | 11/1926 | Australia | 52/200 |
| 1909599 | 12/1970 | Fed. Rep. of Germany | 52/200 |
| 2856835 | 7/1980 | Fed. Rep. of Germany | 52/200 |

OTHER PUBLICATIONS

Progressive Architecture Publication, p. 163, Mar. 1955.

*Primary Examiner*—Carl D. Friedman

*Attorney, Agent, or Firm*—MacDonald J. Wiggins

[57] ABSTRACT

A skylight system for providing an all plastic skylight in a barrel tile roof without the use of a curb. A sheet of plastic has a pair of longitudinal edges bent upward at a right angle to form a standing seam edge. A dome is formed in the center portion of the plastic sheet. The upper edge of the sheet is provided with a riser and is fastened to the roof sheathing adjacent an opening in the roof. A horizontal row of tiles rests on the riser. The lower edge is formed to match the contour of a horizontal row of tiles and is attached thereto. Anchor clips are attached adjacent the longitudinal edges of the opening and abut the standing seam edges. A plurality of step flanges also abut the standing seam edges to form a standing seam engaged by the anchor clips. The step flanges are formed to the contours of a vertical row of tiles and attached thereto. A batten strip is placed over the standing seam.

18 Claims, 8 Drawing Figures

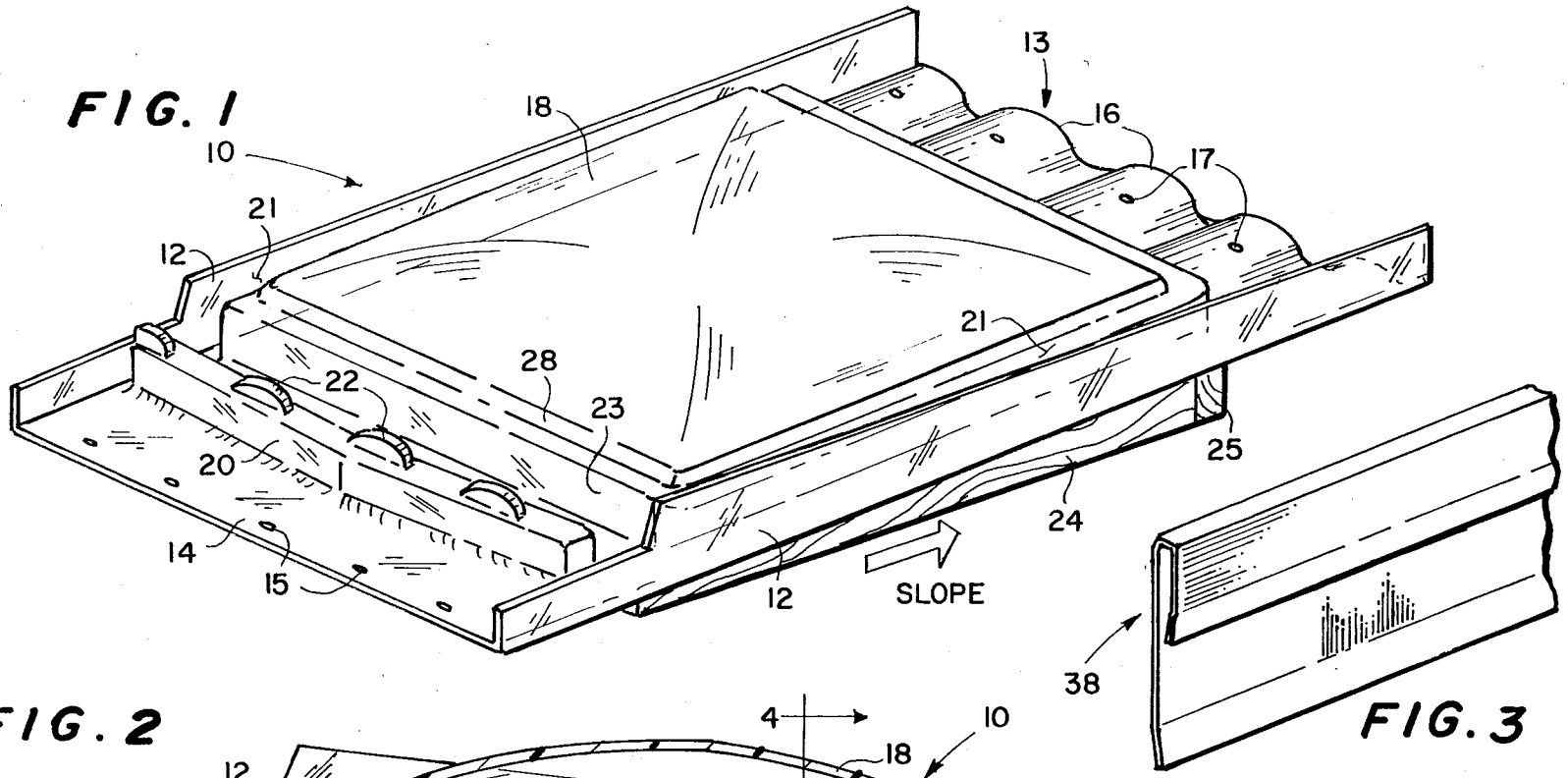
FIG. 1
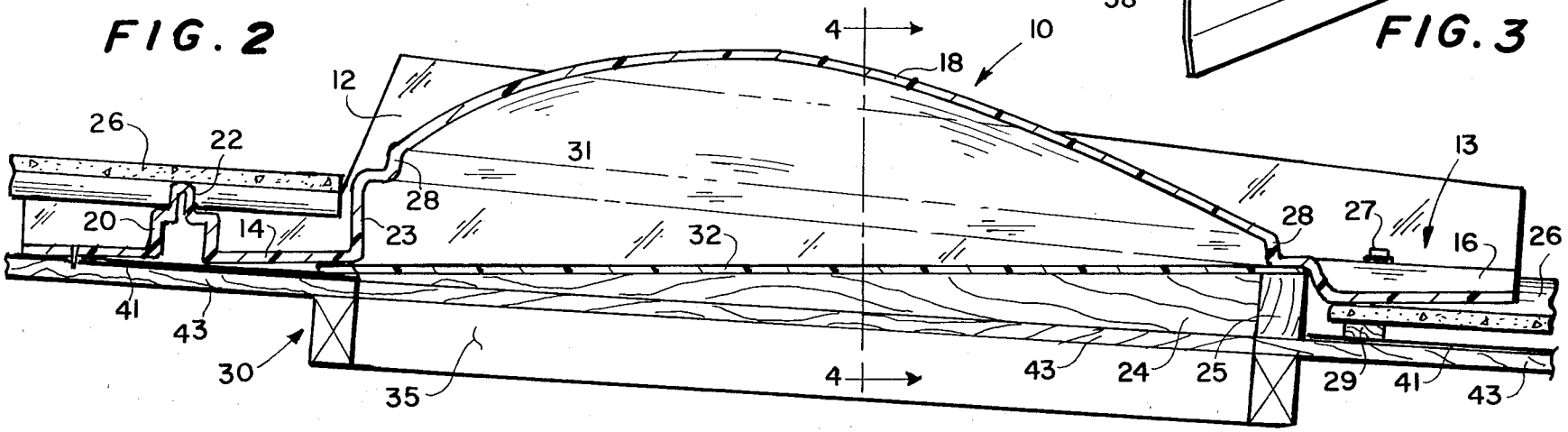
FIG. 2
FIG. 3

FIG. 4
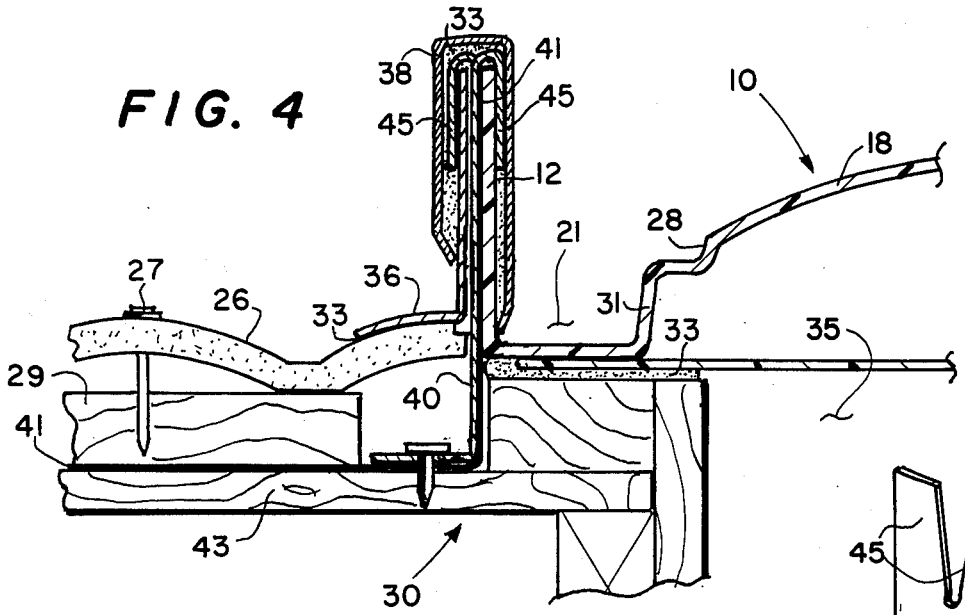
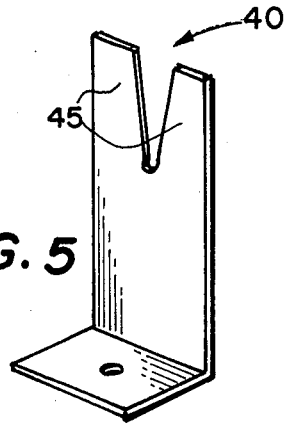
FIG. 5
FIG. 6
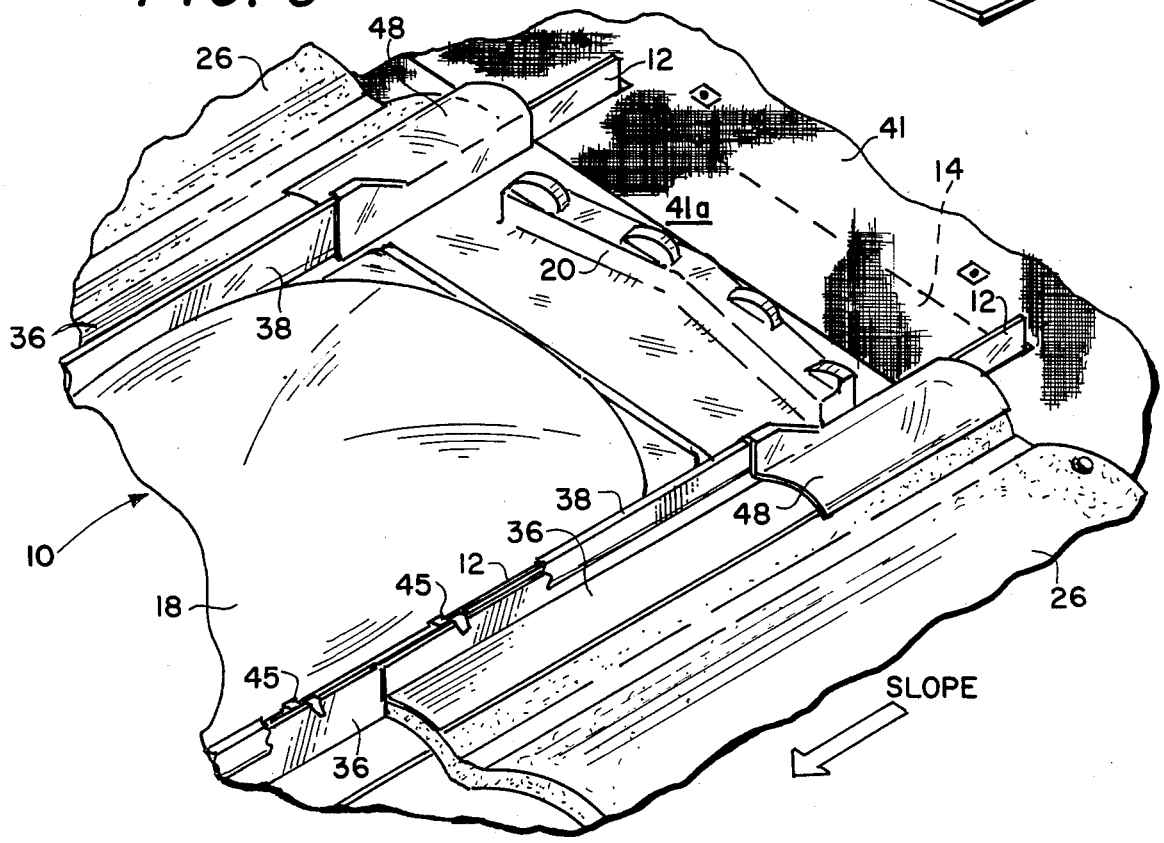

STANDING SEAM SKYLIGHT FOR TILE ROOFS

This application is a continuation-in-part of co-pending application, Ser. No. 700,106 filed 2/11/85 now, U.S. Pat. No. 4,649,680.

BACKGROUND OF THE INVENTION

1. Field of the Invention

The present invention relates to a skylight system for clay tile roofs and the like, and more particularly to a skylight system providing a simple and leakproof installation in such roofs.

2. Description of the Prior Art

In co-pending U.S. patent application, Ser. No. 700,106, a novel standing seam roof skylight suitable for installing in a standing seam metal roof or in a shingle roof without the necessity of building a curb therefor is described. Curbs are used with skylights on sloping roofs to raise the plane of the juncture between the skylight and the roof above the plane of the roof to inhibit leakage, a major problem in the installation of skylights. However, the curb has several disadvantages including the cost to fabricate, and the tendency of debris to collect on the upper end of the curb. The standing seam skylight system described in the above-referenced patent application obviates the need for a curb construction yet places the joints above the plane of the roof to insure a leak-resistant installation.

When a skylight is to be installed in a roof using barrel-type clay tile, the standing seam system referred to is not suitable and, in the prior art, a curb has been required. The present invention is a modification and improvement of the above-referenced standing seam skylight system which permits a low cost, leakproof installation in a barrel tile roof without the necessity of construction of a curb.

SUMMARY OF THE INVENTION

The skylight system for a barrel tile roof includes a skylight formed from a sheet of plastic, such as polycarbonate sheet, having a pair of longitudinal standing seam elements. A skylight dome is formed between the standing seam elements and disposed so as to form a pair of drainage channels on each side thereof. A flat upper edge of the skylight is formed to be fastened to the roof deck and includes a transverse riser portion to support the lower ends of a row of tiles contiguous with the upper end of the skylight dome. This riser portion includes a plurality of arcuate protrusions which match the underside curvature of the tiles and act as birdstops. The riser portion is formed in a prow shape such that water which normally flows beneath the tiles will be diverted to drainage channels. The lower end of the skylight is formed to match the outside contour of the barrel shaped tiles and includes nailing holes therethrough.

It is preferable that the width of the skylight be equal to the width of an integral number of roof tiles. Thus, a tile joint will occur at each standing seam. The height of the standing seams is selected to extend somewhat above the plane of the roof tiles. The skylight is held in place over a suitable roof opening by nailing the upper end to the roof deck and nailing the lower end through the lower tiles into the usual roof tile cleat strips. A plurality of anchor clips is nailed to the roof deck adjacent each of the two standing seam portions of the skylight. One prong of each clip is folded over the standing seam portion and serves to anchor the longitudinal edges of the skylight to the roof deck. After installation of the anchor clips, the remainder of the tiles along the standing seams is installed with the tiles abutting the standing seams.

A set of especially formed step flashings having a straight vertical portion and a curved horizontal portion is installed as the tiles are put in place. The curved horizontal portions of the flashings are formed to match the curvature of the top surface of the barrel tiles. A sealant is placed between the curved portions of the step flashings and the tile surfaces. After the tiles and step flashings are in place, the other prongs of the anchor clips are folded over the vertical portions of the step flashings and a weather cap extending the length of the standing seam is then installed over each standing seam and the vertical portions of the step flashings. At the upper end of the standing seams, a pair of shrouds is installed to seal the ends of the standing seam and upper step flashings. Thereafter, the row of tiles adjacent the upper ends of the skylight is installed. As will be understood, a suitable sealant is used on all joints between the roof sheathing and the skylight portions.

It is therefore a principal object of the invention to provide a standing seam skylight for installation in a barrel tile roof without the use of a curb and which raises the edge seams above the plane of the tile roof.

It is another object of the invention to provide a standing seam skylight system having an all plastic skylight formed to fit the contours of a barrel tile roof and having step flashing to prevent leakage thereof.

It is still another object of the invention to provide an all plastic skylight suitable for installation in a barrel tile roof which is low cost and can be installed by relatively unskilled workmen.

These and other objects and advantages of the invention will become apparent from the following detailed description when read in conjunction with the drawings.

BRIEF DESCRIPTION OF THE DRAWINGS

FIG. 1 is a perspective view of the plastic skylight of the invention;

FIG. 2 is a cross-sectional view of the skylight of FIG. 1 partially installed in a barrel tile roof showing the joints between the roof tiles and the upper and lower ends of the skylight;

FIG. 3 is a partial perspective view of a weather cap used in sealing the standing seam portions of the skylight system of the invention;

FIG. 4 is a cross-sectional view through the plane 4—4 of FIG. 2 for a completed installation showing the standing seam arrangement;

FIG. 5 is a perspective view of a typical anchor clip such as shown in the installation of FIG. 4;

FIG. 6 is a partial perspective view of the skylight of FIG. 1 during installation in a barrel tile roof with portions cut away to show details of the installation;

DETAILED DESCRIPTION OF THE PREFERRED EMBODIMENT

Figure 7:
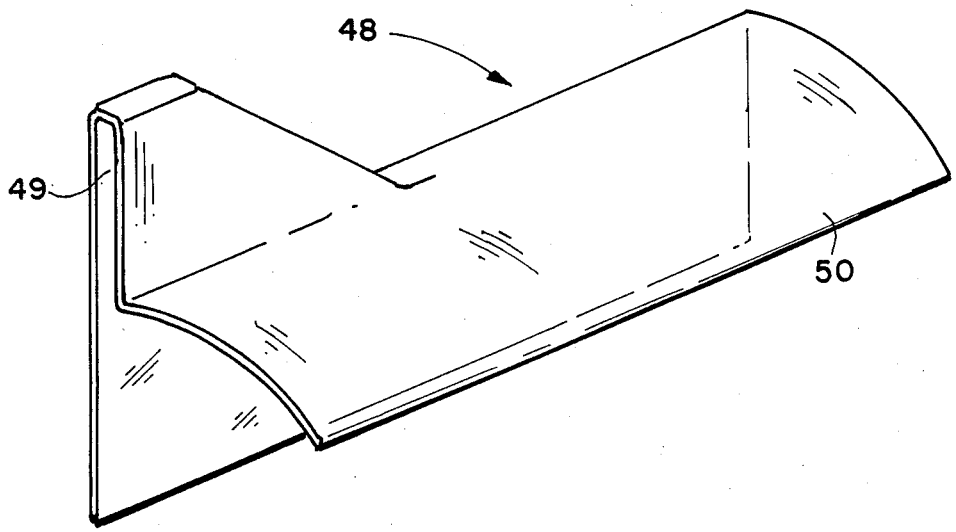
FIG. 7 is a perspective view of a shroud as used in the installation of FIG. 6.

Referring to FIG. 1, a perspective view of a typical plastic skylight portion of the skylight system of the invention is shown. Skylight 10 is to be installed on a sloping roof having barrel-type clay tiles with the slope of the roof in the direction indicated by the arrow. As will be discussed in more detail hereinafter, the width of skylight 10 is selected to be equal to an integral number of tile roof sections. For example, the skylight 10 of FIG. 1 has a width equal to two tile roof sections.

Skylight 10 is preferably formed from polycarbonate sheet which has superior strength characteristics for skylight use. Skylight 10 is formed from a single sheet and is thermoformed with a free-formed dome portion 18. The upper end 14 of skylight 18 is shown having a plurality of nail holes 15 for nailing to the roof deck. The lower end 13 is formed to fit over a row of tiles by means of ridges 16 in which the inner contour essentially matches the top contour of a row of tiles. A series of nail holes 17 is provided in lower end 13 to match nailing holes in the tiles. Upper end 14 includes a riser 20 upon which the lower end of a row of tiles will rest when skylight 10 is installed. The height of riser 20 is such that the lower ends of the row of tiles resting threon will be at the same height as other tiles in the same row. A plurality of protrusions 22 is provided on the top of riser 20, each of which have a curvature to match the curvature of the underside of the roof tiles. Protrusions 22 serve as birdblocks to prevent birds from entering and building nests under the tiles. It may be noted that riser 20 has a prow shape in that the two halves thereof taper slightly toward the lower end of skylight 10. As is well known in the art, clay barrel tile roofs permit about 20% of rainfall to penetrate under the tiles and the normal 45 pound felt subroofing used provides the necessary watertight integrity of the roof. The shape of riser 20 causes any water flowing onto end 14 to be diverted to either side for drainage via channels 21 as will be explained more fully below.

It is desired that the base of dome 18 of skylight 10 be in the plane of the tiles. Therefore, it is preferred that dome 18 be formed as best seen in the cross-sectional view in FIG. 2 of a skylight 10 installed in a tile roof. At the upper end of the dome, a vertical portion 23 is provided which raises the edge of the dome 18 essentially level with the upper surface of a tile 26. At the lower end, the dome is also essentially level with the upper portion of tile 26 and, as seen in FIG. 1, has a portion 16 which essentially mates with tile 26. Thus, it is necessary to install a shim block 25 to support dome 18 and a tapered shim block 24 along the sides of skylight 10. A triangular side skirt portion 31 is provided between shim block 24 and dome 18.

As will be seen in FIG. 1, the sheet plastic is folded upward along the longitudinal sides of skylight 10 to form standing seam portions 12. Standing seam portions 12 are essentially parallel to side skirts 31 to form a pair of drainage channels 21 therebetween. As will now be recognized, water flowing onto upper end 14 will be diverted into drain channels 21 and will be carried to the lower end and drained by the lower tiles. It may also be noted that standing seams 12 have a reduced height at the upper end such that tiles 26 may be placed over the seams at that point as seen from FIG. 2.

In FIG. 2, the skylight 10 is shown installed in a roof 30 having an opening 35 therein. At the lower end 13, a tile 26 seen in cross-section is shown resting on a nailing cleat 29 to which the tile as well as end 13 is secured by nail 27. At the upper end, upper end 14 is seen to be nailed to the roof decking 43 and a tile 26 is resting on riser 20 with protrusion 22 contacting the underside of tile 26. In the skylight 10 of FIG. 2, a second dome or flat sheet 32 is installed and bonded to dome 18 to form an insulating dead airspace therebetween. To improve the insulating qualities, a push or vertical portion 28 is provided at the edges of dome 18.

Referring now to FIGS. 3–5, further details of the installation of skylight 10 in a roof will be shown. A cross-section through plane 4—4 of FIG. 2 is shown in FIG. 4 which illustrates the manner of attaching standing seam 12 to the roof 30. Roofing felt 41 may be noted fastened to roof sheathing 43. A plurality of anchor clips 40, of the type shown in perspective view in FIG. 5, is nailed to the roof sheathing 43 along standing seam 12 over felt 41 with the edges thereof folded up along standing seam 12 of skylight 10. One prong 45 of clip 40 is folded over the top end of standing seam 12 and therefore serves to anchor standing seam 12 of skylight 10 in place. It will be noted that a sealant 33 is applied to shim 24 which effectively produces a watertight seal along the longitudinal edges of the skylight 10. After installation of the anchor clips 40 along standing seam 12, the tiles 26 are installed along the edge of, and in contact with, standing seam 12 and anchor clips 40. Next, a step flashing 36 is trimmed such that its top edge is even with the top edge of standing seam 12. The step flashing has a horizontal portion curved to match the top surface of tile 26. Sealant 33 is applied between flashing 36 and tile 26. The other prong 45 of clip 40 is folded over the vertical portion of step flashing 36 to secure it to standing seam portion 12. After all step flashings 36 are in place, a weather cap 38, shown in detail in FIG. 3, is installed over and along standing seam portion 12 and step flashings 36 with sealant 33 injected into weather cap 38 to prevent water intrusion.

Further details of the installation of skylight 10 in a tile roof are shown in FIG. 6. At the upper end, a flap **41*a* is cut in felt 41 and folded back to permit upper end 14 of skylight 10 to be nailed to roof deck 43 as previously described. The flap 41*a* is then lapped over upper end 14 and sealed with a sealant. FIG. 6 shows weather caps 38 in place over the standing seams with the right hand cap partially cut away to show details of step flashings 36. As will be noted, each flashing 36 is installed on a lower tile, prongs 43 bent over the top edge thereof, and thereafter, the next tile 26 is installed having its lower edge overlapping the upper end of lower step flashing 36, continuing until the installation is in the condition shown in FIG. 6**.

At that point right and left shrouds 48, one of which is shown in perspective view in FIG. 7, are installed over the upper ends of the standing seams. Slot portion 49 is filled with sealant to ensure against water intrusion. Skirt portion 50 is coated with sealant and fitted over the upper flashing 36 and tile 26. Shroud 48 may be molded from sheet plastic or formed from metal. The next row of tiles is then installed, overlapping shrouds 48.

Figure 8:
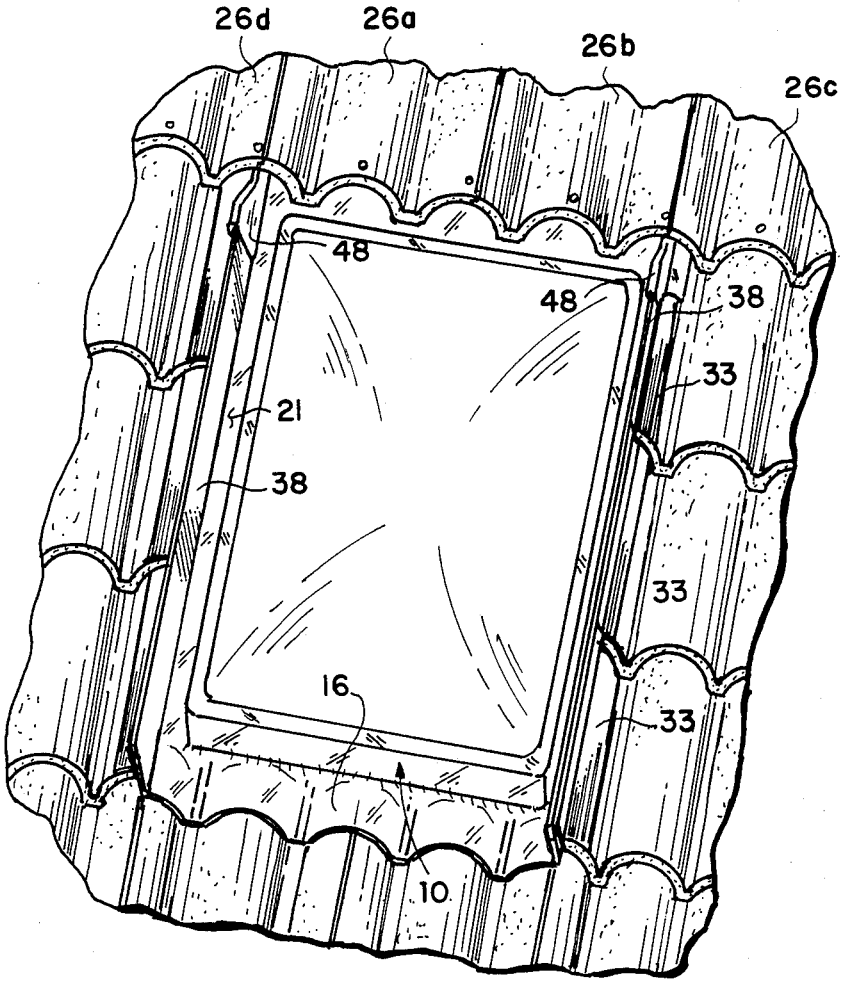
FIG. 8 is a perspective top view of a completed installation of the skylight system of the invention in a barrel tile roof.

Turning now to FIG. 8, a top view of a complete installation is shown. A typical barrel type tile **26*a* is about 12" wide and has rabbeted joints to mate with adjacent tiles 26*d* and 26*b*. Skylight 10 in this example has a width of about 24". Therefore, for this type of tile, skylight 10 would be made in increments of 12" in width. The length is controlled by the requirement to be equal to an integral number of exposed tile lengths. The weather caps 38** are filled with sealant to prevent water intrusion Although a preferred embodiment of the invention has been disclosed, it is to be understood that it is for illustrative purposes only and various modifications thereto may be made without departing from the spirit and scope of the invention.

We claim:

1. A skylight system for installation in a sloping clay-tile roof of the barrel type which includes roof sheathing having a rectangular opening therethrough, said opening having a pair of sloping edges and upper and lower horizontal edges and having a skylight molded from sheet plastic comprising:

a rectangular skylight formed from a sheet of plastic having a pair of parallel longitudinal edges thereof folded upward to form an angle with the plane of said sheet of plastic to thereby produce a pair of standing seam edges;

a flat flange formed along a first lateral edge of said sheet, said flat flange having a riser portion projecting upward therefrom;

a molded flange formed along a second lateral edge of said sheet, said molded flange formed to match the contours of a row of said barrel type roof tiles;

a dome portion in a central portion of said sheet of plastic;

said skylight being disposed over and covering said opening with said standing seam edges disposed along the sloping edges of said opening, said flat flange disposed over said horizontal upper edge of said opening and attached to said roof sheathing and said molded flange disposed over a row of said tiles along said horizontal lower edge of said opening and attached to said tiles and said roof sheathing;

step flashing means disposed along said standing seam edges and having flanges thereof abutting with said standing seam edges, said step flashing means having essentially horizontal flanges thereof formed to match the contours of said barrel type roof tiles, said horizontal flanges attached to roof tiles adjacent said standing seams;

anchor means for attaching said step flashing means and said standing seam edges along said sloping edges of said roof opening; and a horizontal row of said barrel type tiles disposed along and over said flat flange and resting on said riser portion.

2. The system as defined in claim 1 in which said skylight is formed from polycarbonate sheet.

3. The system as defined in claim 1 in which said skylight includes a second dome attached below said dome portion to form a dead air space in said skylight.

4. The system as defined in claim 1 which further comprises a batten disposed over each of said standing seams.

5. The system as defined in claim 4 in which said batten is filled with a sealant material.

6. The system as defined in claim 4 which further includes a shroud disposed over an upper end of said batten.

7. The system as defined in claim 1 in which said riser includes means for preventing entry of birds under tiles resting on said riser.

8. The system as defined in claim 1 in which said riser is prow shaped to promote flow of water around said riser.

9. A skylight system for installation in a sloping clay-tile roof of the barrel type having a skylight molded from sheet plastic comprising:

(a) roof sheathing having a rectangular opening therethrough, said opening having a pair of sloping edges and upper and lower horizontal edges;

(b) a rectangular skylight formed from a sheet of plastic having (i) a pair of parallel longitudinal edges thereof folded upward to form a right angle with the plane of said sheet of plastic to thereby produce a pair of standing seam edges, (ii) a flat flange formed along a first lateral edge of said sheet, said flat flange having a riser portion projecting upward therefrom, (iii) a molded flange formed along a second lateral edge of said sheet, said molded flange formed to match the contours of a row of said barrel type roof tiles, (iv) a dome portion formed in a central portion of said sheet of plastic, and (v) said skylight being disposed over and covering said opening with said standing seam edges disposed along the sloping edges of said opening, said flat flange disposed over said horizontal upper edge of said opening and attached to said roof sheathing and said molded flange disposed over a row of said tiles along said horizontal lower edge of said opening and attached to said tiles and said roof sheathing;

(c) a plurality of anchor clips attached along said sloping edges of said roof opening and abutting said standing seam edges of said skylight;

(d) a plurality of step flashings disposed along said standing seam edges and having vertical flanges thereof abutting with said standing seam edges and said anchor clips, said anchor clips attached to standing seams formed by said vertical flanges and said standing seam edges, said step flashings having essentially horizontal flanges thereof formed to match the contours of said barrel type roof tiles, said horizontal flanges attached to roof tiles adjacent said standing seams; and (e) a horizontal row of said barrel type tiles disposed along and over said flat flange and resting on said riser portion.

10. The system as defined in claim 9 in which said skylight is formed from polycarbonate sheet.

11. The system as defined in claim 9 in which said skylight includes a second dome attached below said dome portion to form a dead air space in said skylight.

12. The system as defined in claim 9 which further comprises a batten disposed over each of said standing seams.

13. The system as defined in claim 12 in which said batten is filled with a sealant material.

14. The system as defined in claim 12 which further includes a shroud disposed over an upper end of said batten.

15. The system as defined in claim 9 in which said riser includes means for preventing entry of birds under tiles resting on said riser.

16. The system as defined in claim 9 in which said riser is prow shaped to promote flow of water around said riser.

17. The skylight as defined in claim 9 in which said riser is prow shaped to direct water flow to said water flow channels.

18. An all-plastic skylight for installation in a sloping barrel tile roof comprising:

an essentially rectangular sheet of plastic having longitudinal edges thereof folded upward to form right angles with said sheet thereby forming a pair of standing seam edges;

a first lateral edge of said sheet forming a flat flange and having a riser projecting upward therefrom for supporting ends of barrel tiles, said flat flange for fastening to a roof sheathing;

a second lateral edge of said sheet formed to have a contour to match the top profile of a lateral row of barrel tiles; and a dome formed in a central portion of said sheet having longitudinal sides spaced apart from said standing seam edges to form a pair of water flow channels, a first lateral side adjacent to and spaced apart from said riser, and a second lateral side essentially contiguous with said contoured second lateral edge of said sheet.

* * * * *